US005221086A

United States Patent [19]

Antonious

[11] Patent Number: 5,221,086

[45] Date of Patent: Jun. 22, 1993

[54] WOOD TYPE GOLF CLUB HEAD WITH AERODYNAMIC CONFIGURATION

[76] Inventor: Anthony J. Antonious, 7738 Calle Facil, Sarasota, Fla. 34238

[21] Appl. No.: 894,345

[22] Filed: Jun. 4, 1992

[51] Int. Cl.[5] ..... A63B 53/04

[52] U.S. Cl. ..... 273/167 E; 273/164.1

[58] Field of Search ..... 273/167-175, 273/164.1, 77 R, 193 R, 194 R, 162 E; D21/217-220

[56] References Cited

U.S. PATENT DOCUMENTS

| | | | |
|---|---|---|---|
| 3,035,839 | 5/1962 | Coglianese | 273/80 C X |
| 3,880,430 | 4/1975 | McCabe | 273/169 X |
| 3,954,270 | 5/1976 | Cook | 273/164.1 |
| 3,955,819 | 5/1976 | Yokich | 273/164.1 |
| 3,997,170 | 12/1976 | Goldberg | 273/167 E X |
| 4,065,133 | 12/1977 | Gordos | 273/173 X |
| 4,139,196 | 2/1979 | Riley | 273/167 H X |
| 4,431,192 | 2/1984 | Stuff | 273/167 E |
| 4,828,265 | 5/1989 | Antonious | 273/169 X |
| 4,900,029 | 2/1990 | Sinclair | 273/167 E |
| 4,930,783 | 6/1990 | Antonious | 273/169 X |
| 5,004,241 | 4/1991 | Antonious | 273/167 E X |
| 5,092,599 | 3/1992 | Okumoto et al. | 273/167 E |

*Primary Examiner*—William H. Grieb
*Assistant Examiner*—Sebastiano Passaniti
*Attorney, Agent, or Firm*—N. J. Aquilino

[57] ABSTRACT

A wood type golf club head having at least a single shallow aerodynamic slot formed on the upper surface of the club head and extending from adjacent the rear edge to a point approximately midway on the upper surface and substantially from the ball striking face. Other embodiments include a plurality of slots in parallel, angular and multiple tier configurations.

4 Claims, 3 Drawing Sheets

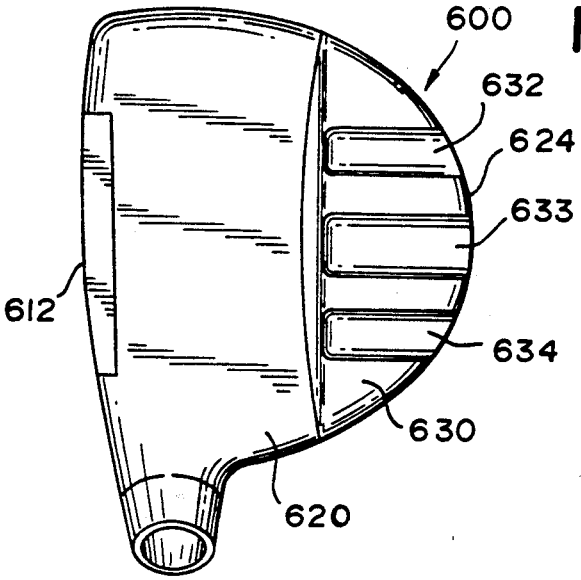
FIG. 9
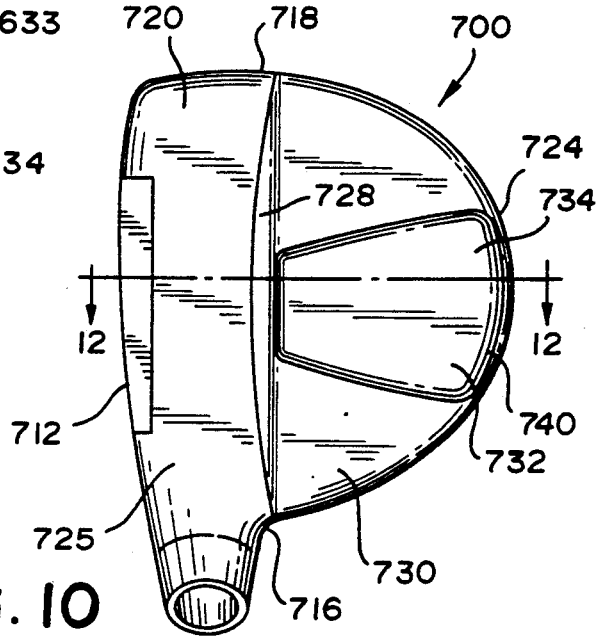
FIG. 10
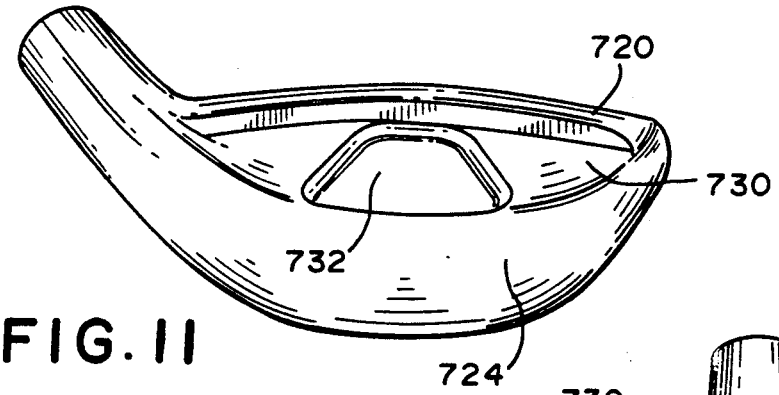
FIG. 11
FIG. 12
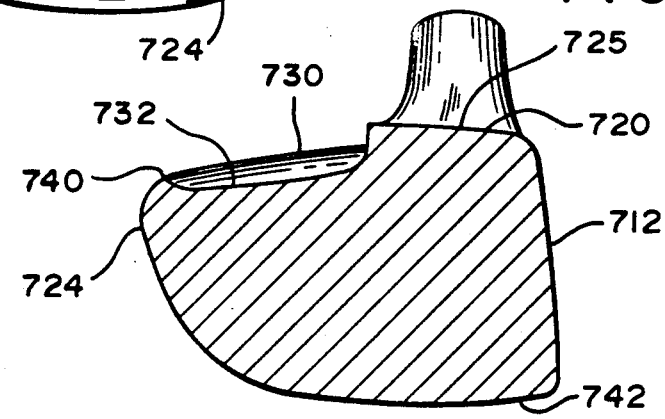

WOOD TYPE GOLF CLUB HEAD WITH AERODYNAMIC CONFIGURATION

BACKGROUND AND SUMMARY OF THE INVENTION

The present invention relates to a wood type golf club head, and in particular, to a wood type golf club head having an improved aerodynamic upper surface.

It has been known that aerodynamic surfaces on golf club heads help increase the stability of the golf club as it is being swung and increase the speed at which the club is swung by producing air currents that produce turbulence, which in turn, affects the aerodynamic drag behind a golf club head.

In my own U.S. Pat. Nos. 4,828,265 and D 318,701, wood type golf club heads are provided with improved aerodynamic characteristics by providing elongated deep slots which extend from just behind the ball striking face to the rear surface of the club head. These structures channel air and causing it to spill over the rear surface, creating a controlled turbulence which decreases club head drag, allowing the club to be swung faster and with increased stability. Other golf club heads having aerodynamic shapes is shown in Milligan U.S. Pat. No. (2,550,846), Gordos U.S. Pat. No. (4,065,153) and Sinclair U.S. Pat. (4,900,029), among others.

In addition, there is a rather large variety of commercially available wood type golf club heads having various aerodynamic features for similar purposes. For example, there are golf clubs having dimples on the club head's outer surface, club heads having protrusions on the outer surface, and various non-planar features to increase the aerodynamic effects of these clubs.

The present invention is directed to a wood type golf club head having an improved aerodynamic surface structure using at least one shallow aerodynamic slot or depression in the upper surface of the club head, positioned from approximately midway on top surface toward the rear surface of the club head. This arrangement permits the greatest aerodynamic activity adjacent the rear portion of the club head where the aerodynamic effects will create the most impressive results in terms of reducing club head drag.

One of the preferred embodiments uses a single slot formed approximately midway of the top surface of the club head and extending rearwardly proximate the upper rear portion thereof. Other embodiments include a plurality of air slots from midway on the top surface to the rear surface, both in parallel and in angular configurations. Still other embodiments contemplate the use of a multi-tiered aerodynamic slot formed at the rear top surface of the club head.

BRIEF DESCRIPTION OF THE DRAWINGS

FIG. 9 is a top plan view of a seventh embodiment of the present invention.

FIG. 10 is a top plan view of a eighth embodiment of the present invention.

FIG. 11 is a rear elevational view of the club head of FIG. 10.

FIG. 12 is a sectional view taken along the lines 12—12 of FIG. 10.

DESCRIPTION OF THE PREFERRED EMBODIMENTS

Figure 1:
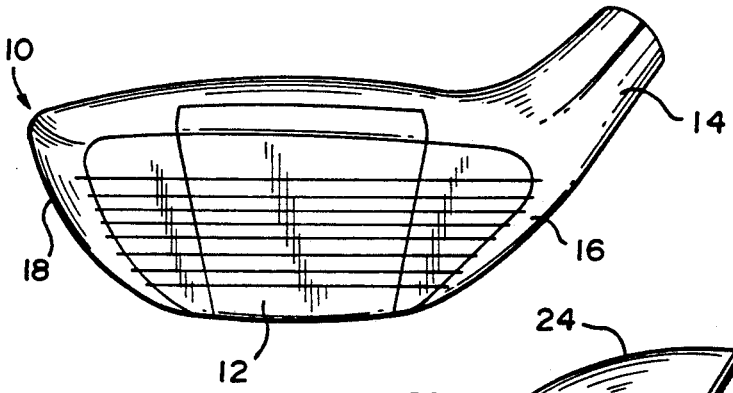
FIG. 1 is a front elevational view of a wood type golf club head in accordance with the present invention.
Figure 2:
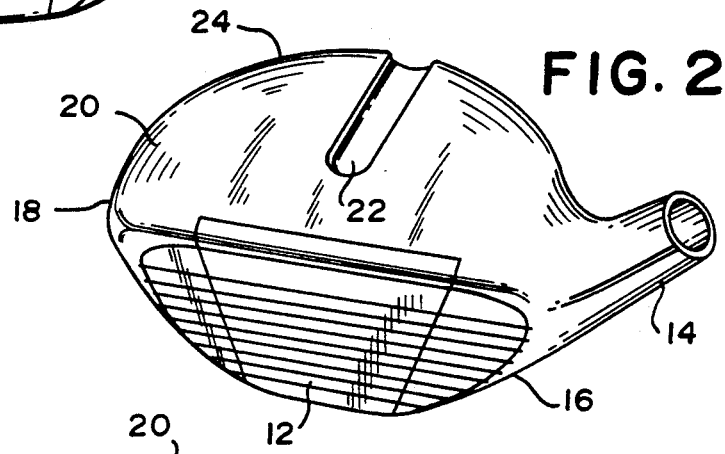
FIG. 2 is a top perspective view thereof.
Figure 3:
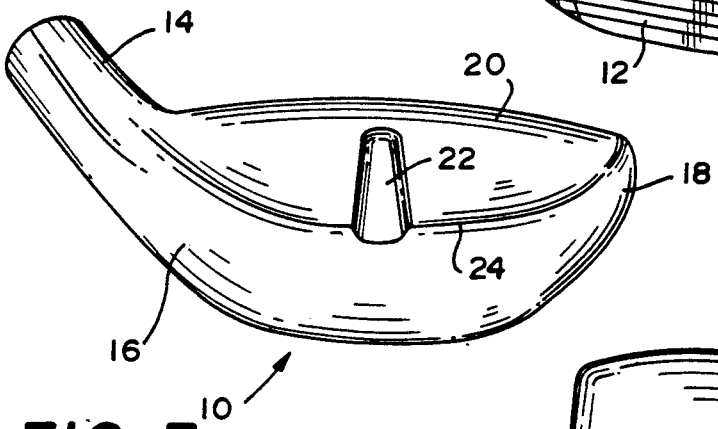
FIG. 3 is a rear elevational view thereof.

Referring to FIGS. 1, 2 and 3, a first embodiment of a golf club head 10 of the present invention is shown, which includes a ball striking face 12, a hosel 14, a heel 16 and toe 18. The club head 10 includes an upper surface 20 and includes a shallow aerodynamic slot 22 formed from a point approximately midway on the upper surface 20 to the rear edge 24 of the club head. Preferably, the slot is less than 0.250 inches and extends in a rear to front direction. The slot 22, if extended, would be approximately perpendicular to the ball striking face.

In use, when a golf club is swung, air spills over the top surface 20 of the club head and is entrained in the slot 22 toward the rear edge 24. The entrainment of the air in the slot directs the flow of air across the top surface, which acts similar to an air foil and creates a controlled jet-air type turbulence at the rear of the club head. This controlled turbulence in turn reduces the drag associated with conventional golf club designs, enabling the club head to accelerate and be swung faster and with greater stability at impact in order to impart increased energy to a golf ball being struck for a given force executed by the golfer.

Figure 4:
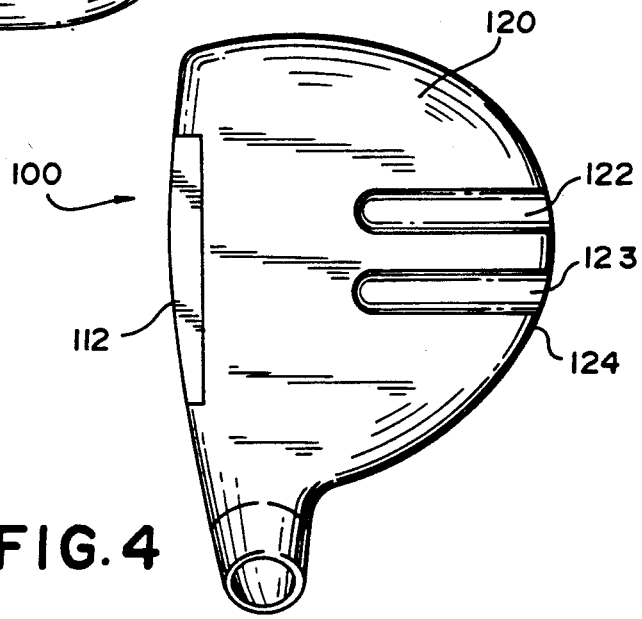
FIG. 4 is a top plan view of a second embodiment of the present invention.

FIG. 4 illustrates a second embodiment of an aerodynamic golf club head 100 of the present invention. In this embodiment, the top surface 120 is provided with a pair of slots 122 and 123 formed proximate the midpoint of the top surface 120 and the rear edge 124 and substantially behind the ball striking face 112. Each of the slots 122 and 123 are of the same width, length and overall configuration.

Figure 5:
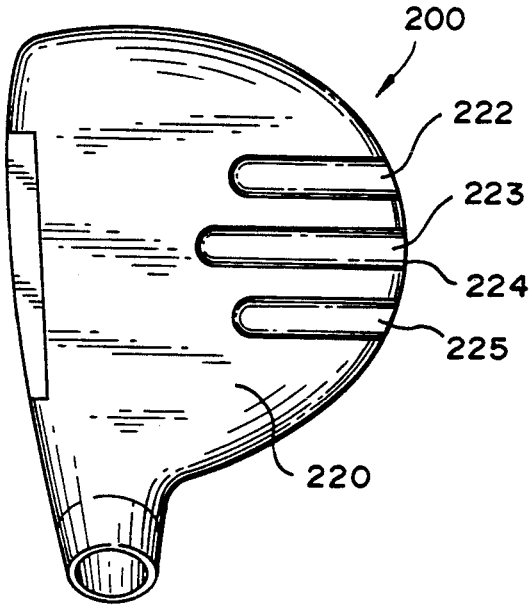
FIG. 5 is a top plan view of a third embodiment of the present invention.

FIG. 5 illustrates a third embodiment of a golf club head 200 of the present invention and includes a plurality of three aerodynamic slots 222, 223 and 225, disposed on the top surface 220, located proximate the midpoint of the top surface and the rear edge 224 of the club head. In this embodiment, the slots are symmetrical with each other but they are of different lengths in a rear to front direction.

Figure 6:
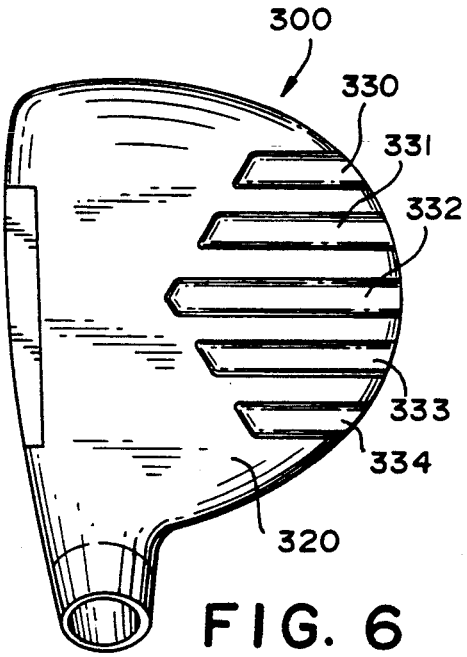
FIG. 6 is a top plan view of a fourth embodiment of the present invention.

FIG. 6 illustrates a fourth embodiment of a golf club head 300 of the present invention, including a plurality of five slots 330, 331, 332, 333 and 334 formed on the top surface 320 of the club head 300. In this embodiment, the slots are of different lengths and configurations.

The embodiments shown in FIGS. 4, 5 and 6 include a variety of different shaped aerodynamic slots. It will be appreciated that the increased number of slots creates a greater number of jet-air type controlled turbulences which in turn affect the aerodynamic drag behind the golf club.

Figure 7:
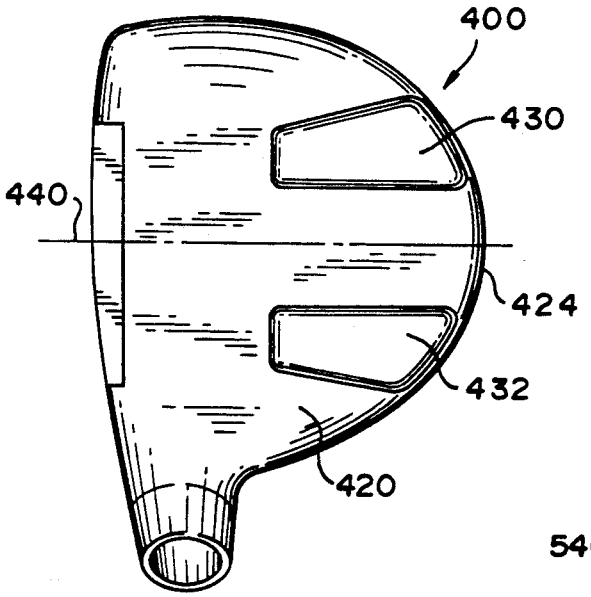
FIG. 7 is a top plan view of a fifth embodiment of the present invention.

FIG. 7 shows a fifth embodiment of a golf club head 400 of the present invention, including a pair of flared trapezoidal-shaped slots 430 and 432 formed on the top surface 420 of the club head from a point proximate the center of the top surface in a front to rear direction to the rear edge 424 of the club head. The slots 430 and 432 are symmetrically spaced on either side of a center line 440, which bisects the top surface 420 of the club head.

Figure 8:
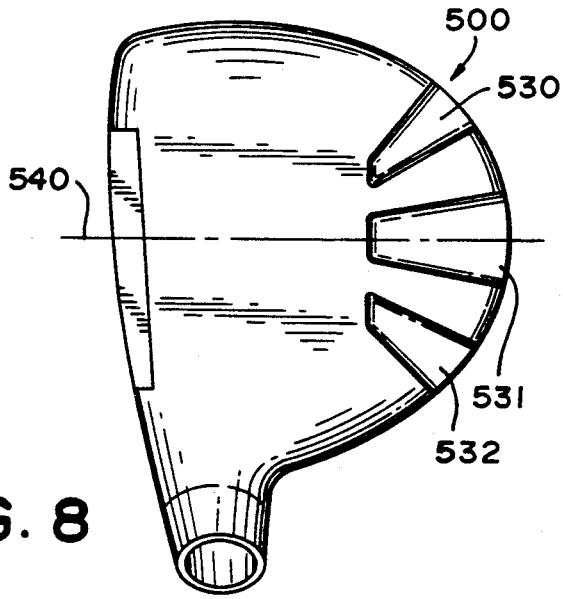
FIG. 8 is a top plan view of a sixth embodiment of the present invention.

FIG. 8 illustrates a sixth embodiment of a golf club head 500 of the present invention, including a plurality of geometrically-shaped slots 530, 531 and 532, which are symmetrically disposed about a center line 540 of the club head 500.

FIG. 9 illustrates a seventh embodiment of a golf club head 600 of the present invention, having an aerodynamic configuration on the top surface 620 in the form of a multiple tier configuration with a step-down ledge 630 formed at a first level and a plurality of aerodynamic slots 632, 633 and 634 formed in the ledge 630 at a second level. Level 630 is formed in the rearward portion of the upper surface 620 and extends approximately ⅓ of the distance from the rear edge 624 to the ball striking face 612.

FIGS. 10, 11 and 12 show an eighth embodiment of golf club head 700 of the present invention, including a top surface 720 having a two-level configuration formed of a first upper level 725 extending rearwardly from the ball striking face 712, and a second upper level 730 formed in the top surface 720 extending forwardly from the rear surface 724 of the club head 700. The intersection of the first upper level 725 and the second upper level 730 forms a linear uninterrupted interface 728 extending substantially between the heel 716 and the toe 718. The club head 700 further includes an aerodynamic slot 732 formed in the second upper level 730 and having a bottom surface 734 forming a third level on the top surface 720 of the club head 700. The rear portion of the aerodynamic slot 732 terminates before the rear surface 724 of the club head 700, forming an upward ramp 740 approximate the rear surface 724. It will be appreciated with reference to FIG. 12 that the three level aerodynamic configuration of the club head 700 is formed on the upper or top portion of the club head, said three levels being disposed above a mid-plane between said upper surface and said sole 742.

As can be seen from FIG. 10, the interface 728 of the first upper level 725 and second upper level 730 is formed near the center portion of the top surface 720 of the club head 700. It will be appreciated that the interface 728 may be moved forwardly or rearwardly, preferably between ⅓ to ⅔ of the distance between the ball striking face 712 and the rear surface 724.

It will be appreciated that the two distinct levels formed in the aerodynamic golf club heads 600 and 700 create a controlled turbulent air flow across the top surfaces of each club head, which in turn reduces the drag, permitting the club to be swung with increased speed and stability.

It is understood that other modifications and changes may be made in the present invention. For example, combining a variety of the different shapes and sizes of air flow channels and slots shown may be provided in keeping within the limitations of the following claims.

I claim:

1. A wood type golf club head having a hosel, a heel, a toe, an upper surface on a top portion of said club head, a rear surface and a ball striking face with a center of percussion thereon and a sole; means for altering air flow across said upper surface, said means including:

a two-level configuration on said upper surface, said two-level configuration including a first level extending from said ball striking face rearwardly and a second level extending from said rear surface forwardly, an interface formed between said first and second levels extending uninterrupted substantially from said heel to said toe; said first and second levels formed on said top portion of the club head;

said second level including at least one shallow aerodynamic air slot formed proximate said rear surface and extending forwardly to said interface of said upper and lower levels;

said air slot having a bottom surface forming a third level on said top surface of said golf club; said three levels being disposed above a mid-plane between said upper surface and said sole;

said three-levels providing an aerodynamic configuration on said top surface of said club head for altering air flow across said surface.

2. The golf club head of claim 1 formed with multiple air slots.

3. The golf club head of claim 1 wherein said air slot is formed with an upward ramp adjacent said rear surface.

4. The golf club head of claim 1 wherein the air slot has a depth of less than 0.250 inches.

* * * * *